US008534569B2

(12) United States Patent
Hamaguchi

(10) Patent No.: US 8,534,569 B2
(45) Date of Patent: Sep. 17, 2013

(54) COOLING DEVICE FOR VEHICLE

(75) Inventor: Ryu Hamaguchi, Aichi-ken (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 777 days.

(21) Appl. No.: 12/674,025

(22) PCT Filed: Aug. 27, 2008

(86) PCT No.: PCT/JP2008/065273
§ 371 (c)(1),
(2), (4) Date: Feb. 18, 2010

(87) PCT Pub. No.: WO2009/028539
PCT Pub. Date: Mar. 5, 2009

(65) Prior Publication Data
US 2011/0297365 A1 Dec. 8, 2011

(30) Foreign Application Priority Data
Aug. 28, 2007 (JP) ..... 2007-221510

(51) Int. Cl.
*F01P 7/02* (2006.01)
*F01P 9/00* (2006.01)

(52) U.S. Cl.
USPC ..... 236/34.5; 123/41.1

(58) Field of Classification Search
USPC ..... 236/34.5, 34, 93 R; 165/300; 123/41.1, 123/41.44, 41.29; 237/12.3 B
See application file for complete search history.

(56) References Cited

U.S. PATENT DOCUMENTS

| | | | | |
|---|---|---|---|---|
| 5,184,773 | A | 2/1993 | Everingham | |
| 6,394,045 | B1 | 5/2002 | Perset | |
| 6,405,688 | B1 * | 6/2002 | Dahm et al. | 123/41.1 |
| 6,460,492 | B1 | 10/2002 | Black et al. | |

FOREIGN PATENT DOCUMENTS

| | | |
|---|---|---|
| JP | U-61-175534 | 11/1986 |
| JP | A-2-146219 | 6/1990 |
| JP | U-3-43529 | 4/1991 |
| JP | A-8-319828 | 12/1996 |
| JP | A-10-19160 | 1/1998 |
| JP | A-2004-308743 | 11/2004 |
| JP | A-2006-37889 | 2/2006 |
| WO | WO 2007/108273 A1 | 9/2007 |

OTHER PUBLICATIONS

International Preliminary Report on Patentability issued in International Patent Application No. PCT/JP2008/065273 on Sep. 22, 2008.
International Search Report issued in International Application No. PCT/JP2008/065273; Mailed Sep. 22, 2008.
Oct. 6, 2010 Supplemental European Search Report in European Application No. 08792783.6.

* cited by examiner

*Primary Examiner* — Chen Wen Jiang
(74) *Attorney, Agent, or Firm* — Oliff & Berridge, PLC

(57) ABSTRACT

In a cooling device for a vehicle having a main passage through which coolant water is circulated between the interior of an engine and a radiator 13, a heater passage through which the coolant water is circulated between the interior of the engine and a heater core 15, and a thermostat 18 that operates in response to the temperature of the coolant water and selectively permits and stops circulation of the coolant water in the main passage, the heater passage is used as a heater/bypass passage, which functions also as a bypass passage, through which the coolant medium is circulated without passing through the radiator 13 when the engine warms up. This makes it unnecessary to form a separate bypass passage, thus simplifying the passage configuration.

2 Claims, 7 Drawing Sheets

COOLING DEVICE FOR VEHICLE

FIELD OF THE INVENTION

The present invention relates to a cooling device for a vehicle that maintains the temperature of the engine of the vehicle at an appropriate level by circulating cooling medium.

BACKGROUND OF THE INVENTION

Vehicles have a cooling device that suppresses overheating and overcooling of the engine so as to maintain the temperature of the engine at an appropriate level. A water cooling type cooling device, which cools the engine by circulating coolant water in the interior of the engine, has a water jacket, that is, a coolant water passage extending in a cylinder block and a cylinder head of the engine. The coolant water is circulated through the water jacket by means of a water pump so as to absorb the heat of the engine. The coolant water, which has been heated to a high temperature by the heat of the engine, is then sent to a radiator, which is a heat exchanger. The coolant water is thus cooled by the air blowing through the radiator and returned to the water jacket.

When the engine must be warmed up, such as immediately after the engine is started, the temperature of the coolant water is quickly elevated to an appropriate level by stopping circulation of the coolant water via the radiator. However, since the water pump typically interlocked to the crankshaft, it is impossible to stop the operation of the water pump. That is, it is impossible to stop the circulation of the coolant water as long as the engine is in operation. To solve this problem, the cooling device for a vehicle has a bypass passage that allows the coolant water to bypass the radiator when circulating. Accordingly, when the engine warms up, the cooling device quickly raises the temperature of the coolant water to the appropriate level by circulating the coolant water via the bypass passage.

Switching of the circulation paths of the coolant water between the path for engine warm-up and the path for after completion of the engine warm-up, which has been described, is performed by a thermostat, which is a temperature sensitive valve that operates in response to the temperature of the coolant water flowing into the valve. Conventionally, for this purpose, various types of thermostats have been proposed and used as described in, for example, Patent Documents 1 to 4. Typical conventional thermostats have the basic configuration described below. Specifically, a thermostat includes a valve body that is moved by thermal expansion and thermal contraction of a substance sealed in a thermo-element, which is a temperature sensitive portion. A wax pellet type thermostat, for example, employs a bullet-like container in which wax is sealed as its temperature sensitive portion. The wax, which is a solid under low temperatures, melts and expands under high temperatures, thus moving the valve body of the thermostat. This selectively opens and closes the valve in such a manner that the coolant water is circulated via the bypass passage when the temperature of the coolant water is low but through the radiator when the temperature of the coolant water is sufficiently high.

The coolant water that has been heated by the engine is used by a heater that raises the temperature in the passenger compartment. In other words, after having been heated by the engine, the coolant water is sent also to a heater core, which is a heat exchanger, and used by the heater core to warm the air that is blown into the passenger compartment.

A cooling device for a vehicle employing the water cooling, which has been described above, has a plurality of passages in which the coolant water circulates. Since the coolant water passages have complicated structures, a large number of components and steps are necessary for formation of the passages. Accordingly, it has been demanded that the configuration of passages for the coolant water be simplified to save the manufacturing costs.

Patent Document 1: Japanese Laid-Open Patent Publication No. 02-146219

Patent Document 2: Japanese Laid-Open Patent Publication No. 08-319828

Patent Document 3: Japanese Laid-Open Patent Publication No. 10-019160

Patent Document 4: Japanese Laid-Open Patent Publication No. 2006-37889

SUMMARY OF THE INVENTION

Accordingly, it is an objective of the present invention to provide a cooling device for a vehicle in which the configuration of passages through which cooling medium circulates is further simplified.

To achieve the foregoing objective and in accordance with one aspect of the present invention, a cooling device for a vehicle is provided. The cooling device includes a first passage through which a cooling medium is circulated between the interior of an engine and a radiator, a second passage through which the cooling medium is circulated between the interior of the engine and a heater core, and a thermostat that operates in response to the temperature of the cooling medium. The thermostat permits circulation of the cooling medium in the first passage when the temperature of the cooling medium is high, and stops the circulation of the cooling medium in the first passage when the temperature of the cooling medium is low. The second passage functions as a bypass passage through which the cooling medium circulates bypassing the radiator when the temperature of the cooling medium is low.

DETAILED DESCRIPTION OF THE PREFERRED EMBODIMENTS

An embodiment of the present invention will now be described in detail with reference to FIGS. 1 to 6. A cooling device for a vehicle according to the present embodiment uses, as cooling medium, water in which an anti-freezing agent and an anti-corrosion agent are mixed, or coolant water. The cooling device circulates the coolant water so as to maintain the temperature of the engine at an appropriate level.

Figure 1:
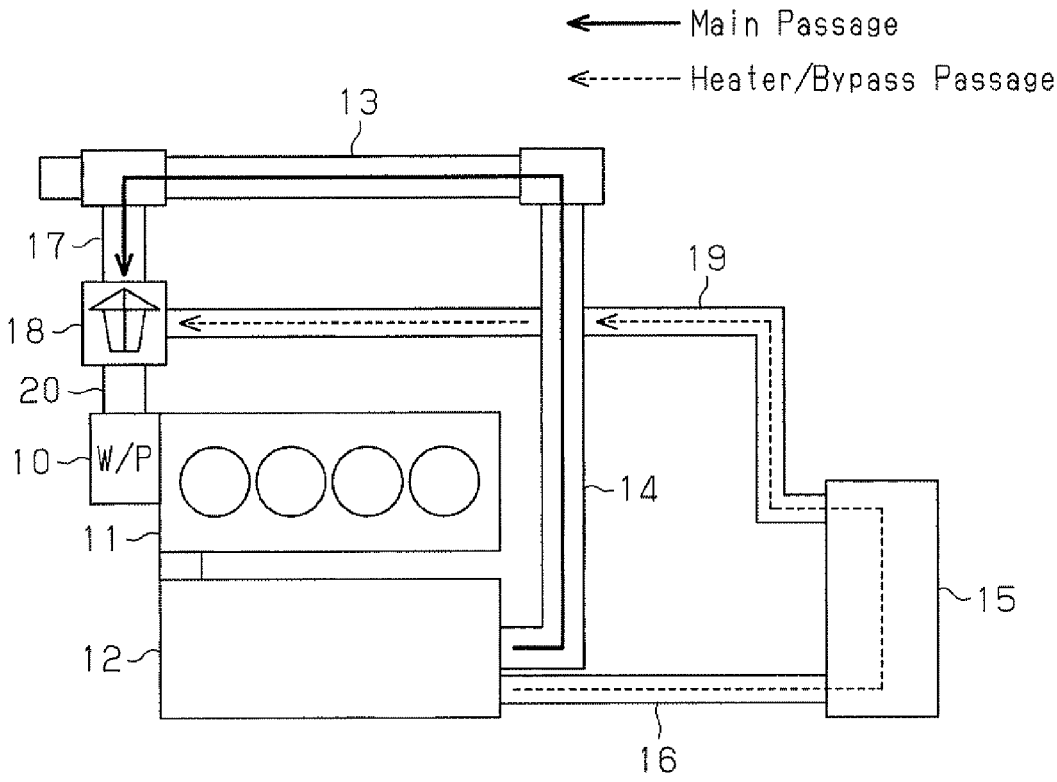
FIG. 1 is a diagram showing the configuration of coolant water passages of a cooling device for a vehicle according to one embodiment of the present invention.

FIG. 1 schematically shows the configuration of coolant water passages formed in the cooling device for a vehicle according to the present embodiment. The cooling device mainly includes a first passage for circulating the coolant water between the interior of the engine and a radiator 13, and a second passage for circulating the coolant water between the interior of the engine and a heater core 15.

An outlet port of a water pump 10, which is interlocked to the crankshaft of the engine, is connected to a water jacket formed in a cylinder block 11 of the engine. The water jacket in the cylinder block 11 is connected to a water jacket formed in a cylinder head 12 of the engine. The water jacket in the cylinder head 12 is branched, at a downstream position, into a radiator inlet passage 14 extending to the radiator 13 and a heater inlet passage 16 extending to the heater core 15.

The coolant water flowing in the radiator inlet passage 14 passes through the radiator 13, which functions as a heat exchanger that cools the coolant water by air flows produced by the vehicle when the vehicle runs or those generated by a fan. The coolant water is then sent to a thermostat 18 via a radiator return passage 17. On the other hand, the coolant water flowing in the heater inlet passage 16 passes through the heater core 15, which functions as a heat exchanger that heats the air blown into the passenger compartment using the coolant water that has been heated by the engine. The coolant water then passes through a heater return passage 19 and flows into the thermostat 18. The thermostat 18 is a temperature sensitive operation type valve, which operates in response to the temperature of the coolant water that has entered the valve. After having been sent to the thermostat 18, the coolant water is returned to the water pump 10 via an inlet line 20.

As has been described, as the first passage, the cooling device has a main passage, through which the coolant water is circulated sequentially through the water pump 10, the cylinder block 11, the cylinder head 12, the radiator inlet passage 14, the radiator 13, the radiator return passage 17, the thermostat 18, the inlet line 20, and then back to the water pump 10. Further, as the second passage, the cooling device has a heater/bypass passage, through which the coolant water is circulated sequentially through the water pump 10, the cylinder block 11, the cylinder head 12, the heater inlet passage 16, the heater core 15, the heater return passage 19, the thermostat 18, the inlet line 20, and then back to the water pump 10.

In the present embodiment, the thermostat 18 operates in correspondence with the temperature of the coolant water flowing into the thermostat 18. Specifically, when the temperature of the coolant water is low, such as when the engine is warming up, the thermostat 18 stops circulation of the coolant water through the main passage. When the temperature of the coolant water is high, such as after the engine warm-up has been completed, the thermostat 18 permits the circulation of the coolant water through the main passage. On the other hand, the thermostat 18 constantly permits circulation of the coolant water through the heater/bypass passage regardless of the temperature of the coolant water. However, when the temperature of the coolant water is high, the thermostat 18 limits the circulation of the coolant water through the heater/bypass passage, that is, increases the flow resistance to the coolant water circulating through the heater/bypass passage, compared to when the temperature of the coolant water is low. Such configuration of the thermostat 18 will be described below.

Figure 2A:
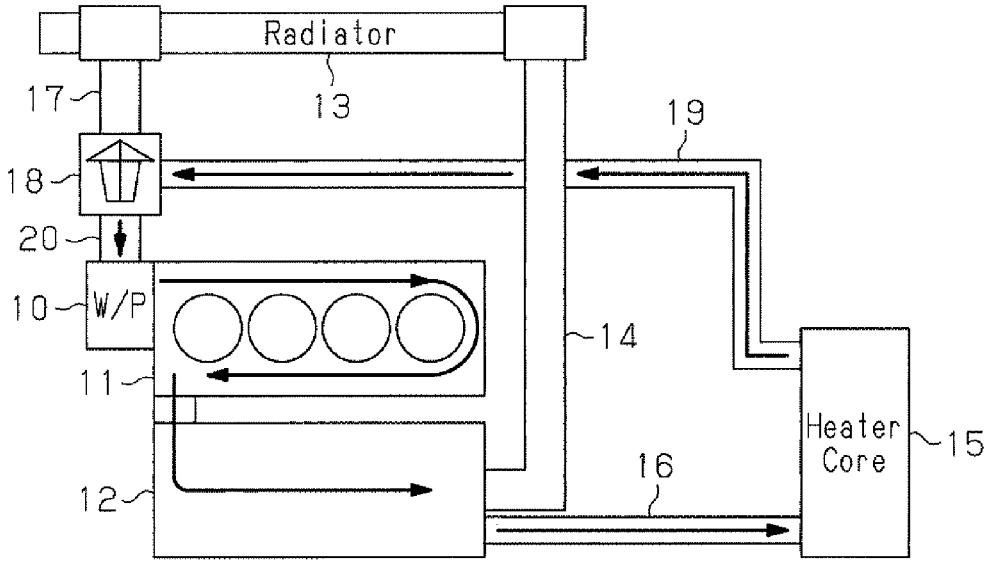
FIG. 2A is a diagram showing circulation of the coolant water in the cooling device of FIG. 1 when the engine warms up.
Figure 2B:
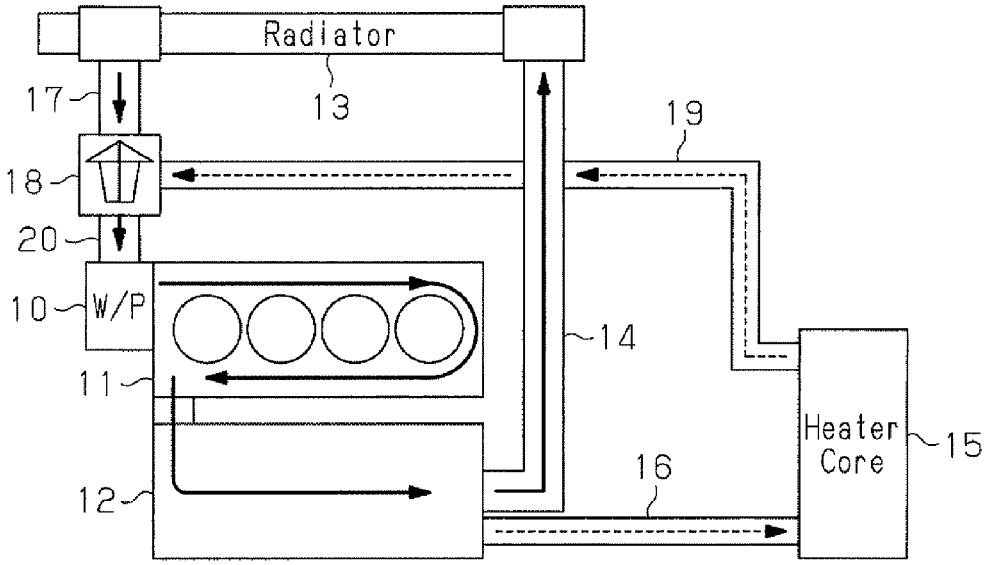
FIG. 2B is a diagram showing circulation of the coolant water in the cooling device of in FIG. 1 after the engine warm-up has been completed.

Circulation of the coolant water in the cooling device of the present embodiment, which has the above-described configuration, will hereafter be explained for states when the engine is warming up and after the engine warm-up has been completed. FIG. 2A illustrates the circulation of the coolant water when the engine is warming up, which is when the temperature of the coolant water is low. FIG. 2B illustrates the circulation of the coolant water after the engine warm-up has been completed, that is, when the temperature of the coolant water is high.

As has been described, the thermostat 18 stops the circulation of the coolant water through the main passage passing through the radiator 13 when the temperature of the coolant water is low. Accordingly, as illustrated in FIG. 2A, all the coolant water is circulated through the heater/bypass passage.

On the other hand, when the temperature of the coolant water is high, the thermostat 18 permits the circulation of the coolant water through the main passage passing through the radiator 13. The circulation of the coolant water through the heater/bypass passage passing through the heater core 15 is constantly permitted regardless of the temperature of the coolant water. Accordingly, in this state, the coolant water flows through both of the main passage and the heater/bypass passage as illustrated in FIG. 2B. In this state, the thermostat 18 limits the circulation of the coolant water through the heater/bypass passage, that is, increases the flow resistance to the coolant water circulating through the heater/bypass passage, compared to when the temperature of the coolant water is low. Accordingly, the higher the temperature of the coolant water, the smaller the amount of the coolant water circulating through the heater/bypass passage becomes and the greater the amount of the coolant water circulating through the main passage becomes. This ensures a sufficient amount of coolant water circulating through the radiator 13 and thus effectively maintains the cooling performance of the engine. The thermostat 18 is configured in such a manner as to prevent the amount of the coolant water circulated through the heater/bypass passage from becoming less than the amount necessary for ensuring passenger compartment heating performance (heating performance required for the heater core 15).

Figure 3A:
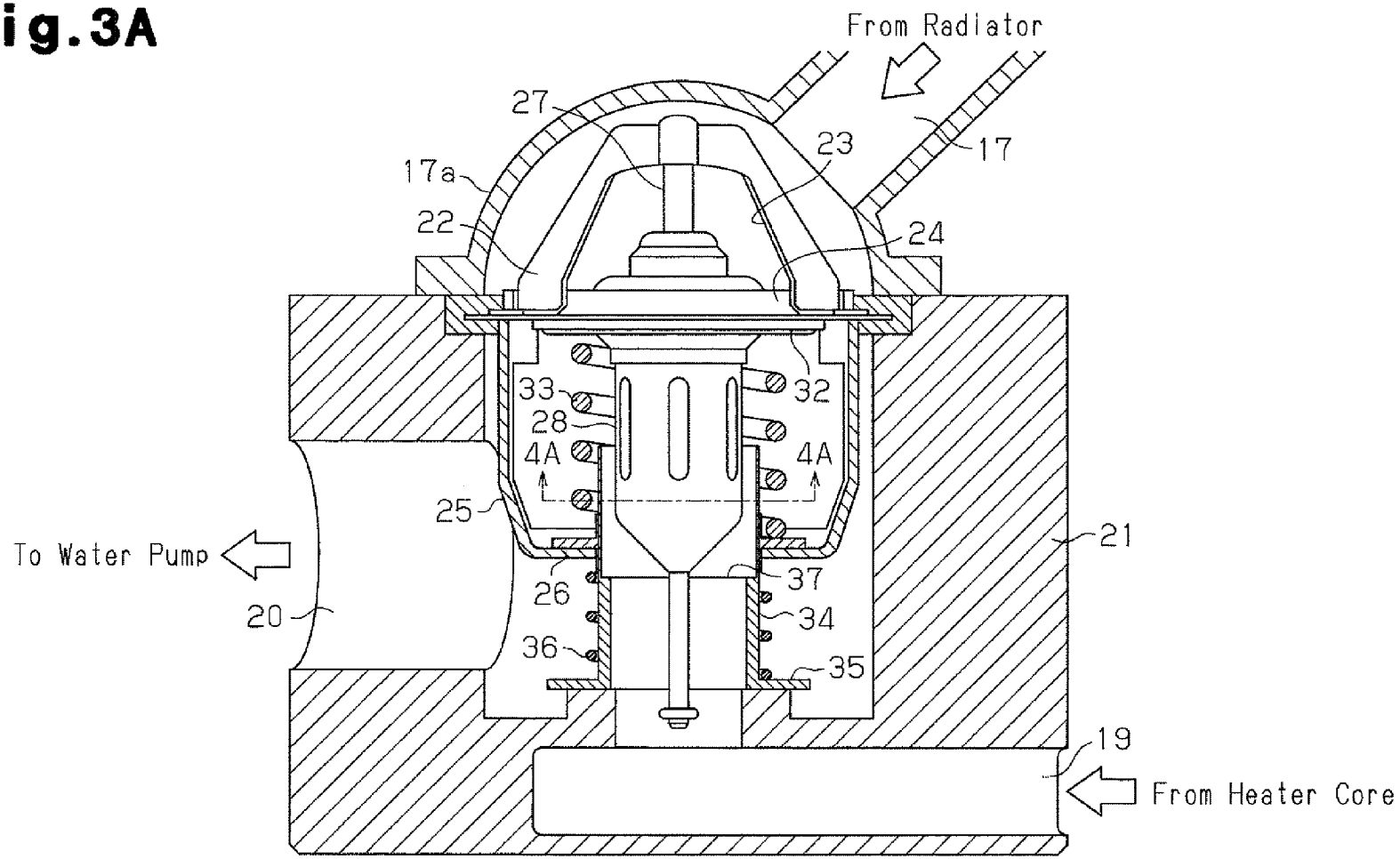
FIG. 3A is a cross-sectional view showing the configuration of a thermostat employed in the cooling device of FIG. 1, when the thermostat is in a valve closed state.

The structure of the thermostat 18 will now be explained in detail. FIG. 3A shows a lateral cross-sectional configuration of the thermostat 18 at the time when the thermostat 18 is in a valve closed state, which is when the thermostat 18 stops the circulation of the coolant water through the main passage. FIG. 13B shows the lateral cross-sectional configuration of the thermostat 18 at the time when the thermostat 18 is in a valve open state, which is when the thermostat 18 permits the circulation of the coolant water through the main passage.

As shown in the drawings, the thermostat 18 is mounted in a thermostat housing 21 formed in a portion at which the radiator return passage 17, the heater return passage 19, and the inlet line 20 converge. The thermostat housing 21 has a cylindrical shape having an opening formed in a top surface. A dome-like joint portion 17*a*, which joins the radiator return passage 17 with the thermostat housing 21, is attached to an upper portion of the thermostat housing 21 in such a manner as to cover the opening of the thermostat housing 21. An opening communicating with the heater return passage 19 is formed in an inner bottom surface of the thermostat housing 21. An opening communicating with the inlet line 20 is formed in a side surface of the thermostat housing 21.

The thermostat 18 also has a body frame 22, which is fixedly arranged between the thermostat housing 21 and the joint portion 17*a*. The body frame 22 has a water port 23, which is formed in a side surface of an upper portion of the body frame 22. An annular valve seat 24, which has an opening at the center, is integrally fixed to the body frame 22. An arm 25, which extends downward from the body frame 22 and has a spring seat 26 fixed to the distal end of the arm 25, is fixed to the body frame 22.

A valve shaft 27 is fixed to an upper portion of the body frame 22. The valve shaft 27 supports a temperature sensitive portion of the thermostat 18, which is a thermo-element 28, in a manner movable in an up-and-down direction along the valve shaft 27. The thermo-element 28 includes a sleeve and a bullet-like casing both formed of flexible material, which are engaged with the valve shaft 27. A sealed space is formed between the sleeve and the casing and filled with wax.

A valve body 32, which can be seated on the valve seat 24 to close the opening of the valve seat 24, is integrally fixed to an upper portion of the thermo-element 28. A spring 33 is arranged between the valve body 32 and the spring seat 26 in a compressed state. The spring 33 urges the thermo-element 28 and the valve body 32 upward, that is, in the direction in which the valve body 32 is moved to be seated on the valve seat 24.

A guide member 34, which is substantially shaped as a circular tube, is fixed to a lower portion of the thermostat housing 21 and arranged around the circumference of the thermo-element 28. A spring 36, which is a spring other than the spring 33, is arranged, in a compressed state between a flange 35, which is formed at the lower end of the guide member 34, and the spring seat 26. The spring 36 presses the guide member 34 against the inner bottom surface of the thermostat housing 21 at the circumference of the opening communicating with the heater return passage 19. The coolant water that flows into the thermostat housing 21 via the heater return passage 19 is entirely sent through the interior of the guide member 34 and reaches the space around the thermo-element 28. The guide member 34 has a stepped portion 37, which is formed at the inner circumference of the guide member 34. The inner diameter of the portion of the guide member 34 below the stepped portion 37 is smaller than the inner diameter of the portion of the guide member 34 above the stepped portion 37.

In the thermostat 18, when the temperature of the coolant water sent from the heater return passage 19 to the space around the thermo-element 28 via the guide member 34 is low, the wax sealed in the thermo-element 28 is maintained in a solid state. In this state, the valve body 32 is urged by the spring 33 to be seated on the valve seat 24, as illustrated in FIG. 3A. This causes the valve body 32 to close the opening of the valve seat 24, thus stopping the flow of the coolant water from the radiator return passage 17 to the inlet line 20 and consequently the circulation of the coolant water through the main passage passing through the radiator 13. However, in this state, the flow of the coolant water from the heater return passage 19 to the inlet line 20, which is the circulation of the coolant water through the heater/bypass passage passing through the heater core 15, is permitted through the clearance between the outer circumference of the thereto-element 28 and the inner circumference of the guide member 34. At this stage, the thermo-element 28 is located above the stepped portion 37 of the guide member 34. The clearance between the outer circumference of the thermo-element 28 and the inner circumference of the guide member 34 forms a variable passage.

Figure 3B:
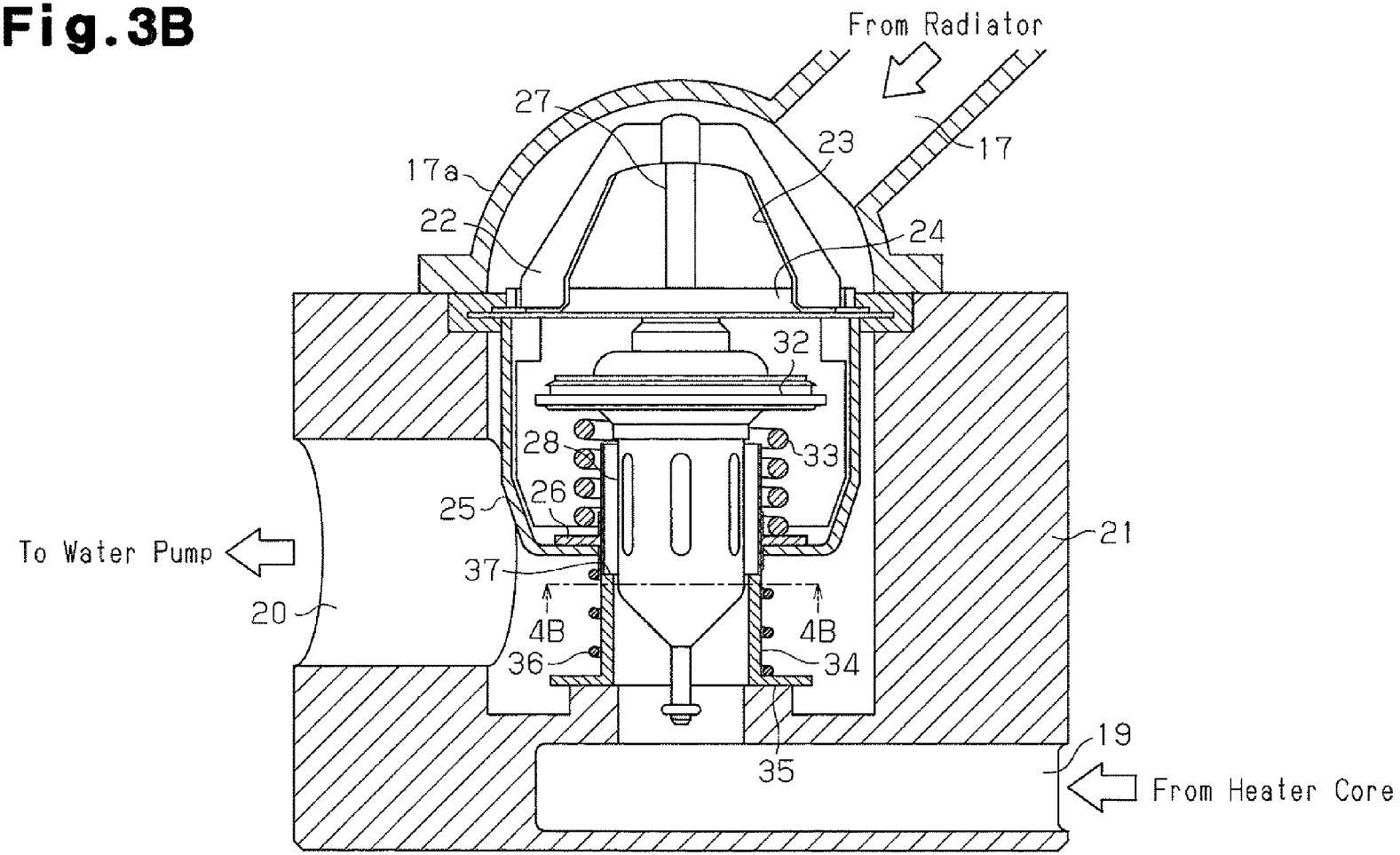
FIG. 3B is a cross-sectional view showing the configuration of the thermostat illustrated in FIG. 3A, when the thermostat is in a valve open state.

When the temperature of the coolant water flowing from the heater return passage 19 is high, the heat of the coolant water heats the wax in the thermo-element 28, thus melting and expanding the wax. As illustrated in FIG. 3B, the expanded wax causes the sleeve of the thermo-element 28 to press the valve shaft 27 upward, thus depressing the thermo-element 28 together with the valve body 32. This separates the valve body 32 from the valve seat 24 and permits the flow of the coolant water from the radiator return passage 17 to the inlet line 20 via the opening of the valve seat 24 and consequently the circulation of the coolant water through the main passage passing through the radiator 13. At this time, a portion of the thermo-element 28 is moved to a position below the stepped portion 37 of the guide member 34.

Figure 4A:
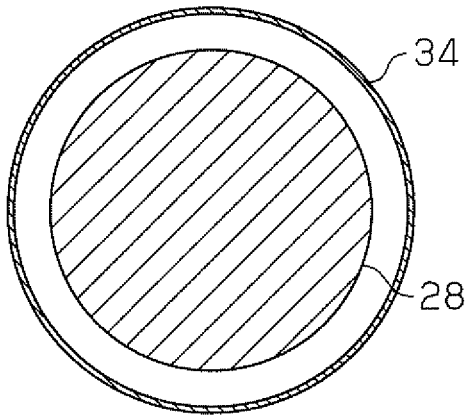
FIG. 4A is a cross-sectional view taken along line 4A-4A of FIG. 3A.
Figure 4B:
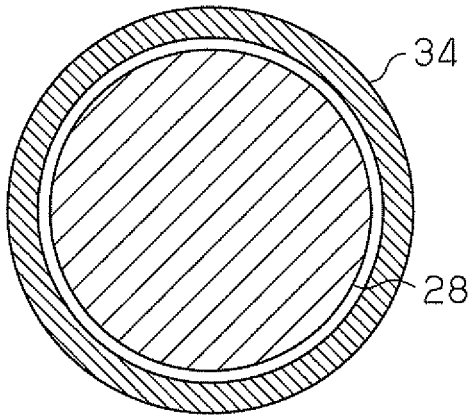
FIG. 4B is a cross-sectional view taken along line 4B-4B of FIG. 3B.
Figure 5:
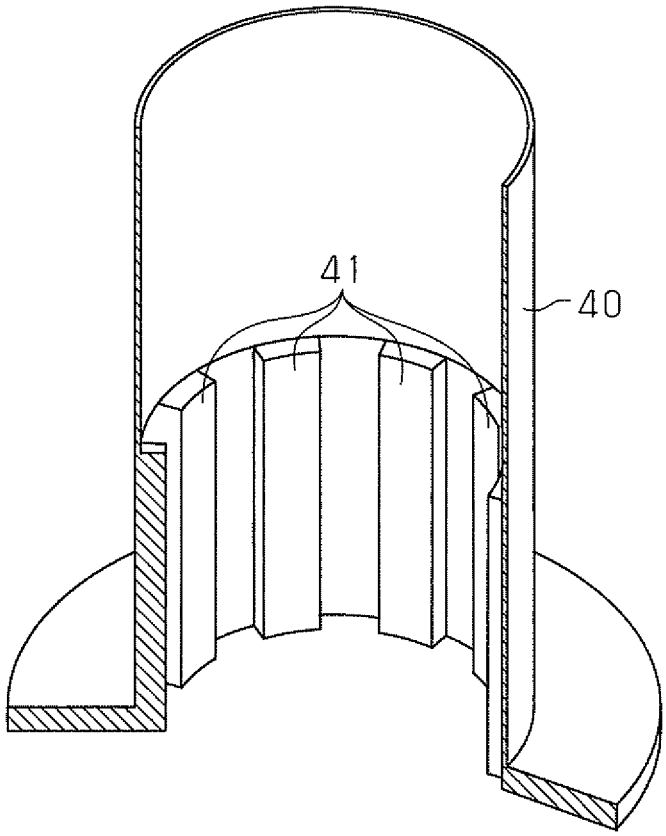
FIG. 5 is a perspective view, with a part cut away, showing a modification of the thermostat employed in the cooling device illustrated in FIG. 1.
Figure 6:
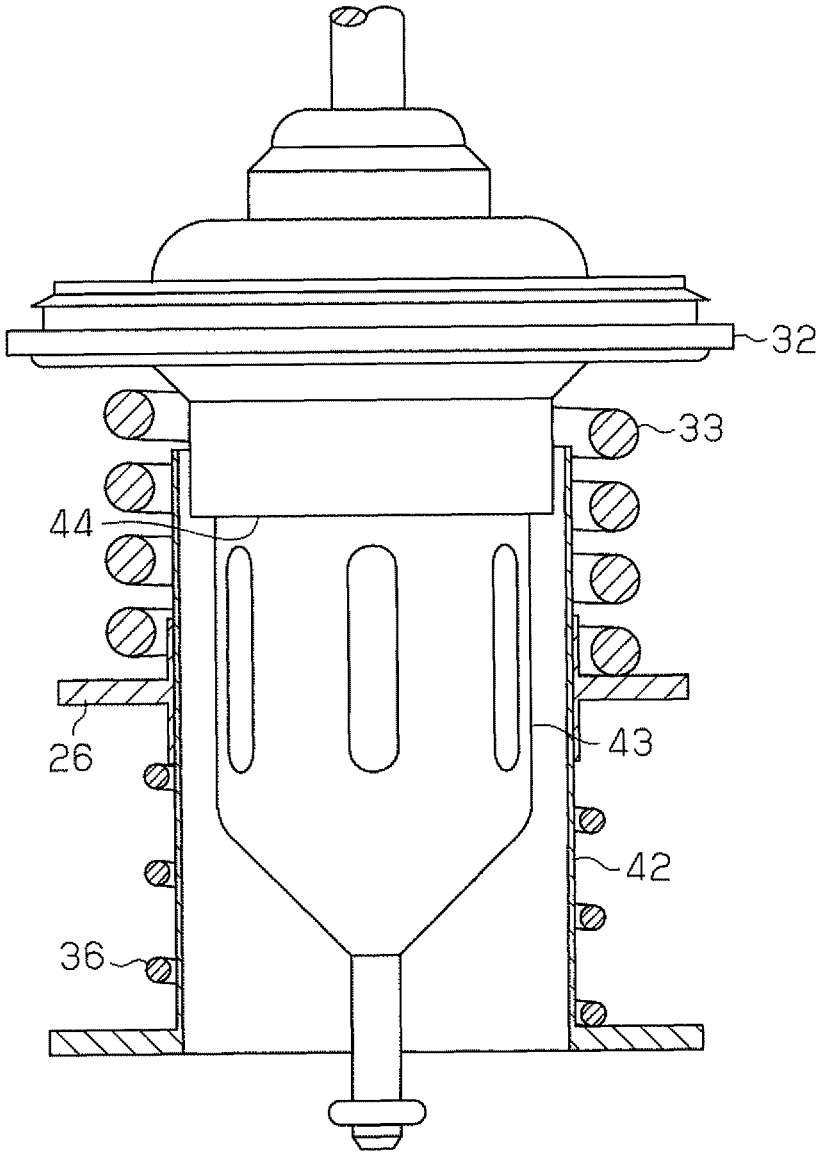
FIG. 6 is a cross-sectional view showing another modification of the thermostat employed in the cooling device illustrated in FIG. 1.

FIG. 4A shows the cross-sectional configuration taken along line 4A-4A of FIG. 3A, which is the cross-sectional configuration of the portion corresponding to the minimum cross-sectional area of the variable passage, which is formed in the clearance between the thermo-element 28 and the guide member 34, at the time when the thermostat 18 is in the valve closed state. In this state, as has been described, the thermo-element 28 is located in the portion of the guide member 34 above the stepped portion 37, that is, the portion of the guide member 34 with the greater inner diameter. Accordingly, the minimum cross-sectional area of the variable passage is relatively great. FIG. 4B shows the cross-sectional configuration taken along line 4B-4B of FIG. 3B, which is the cross-sectional configuration of the portion corresponding to the minimum cross-sectional area of the variable passage, which is formed in the clearance between the thermo-element 28 and the guide member 34, at the time when the thermostat 18 is in the valve open state. In this state, as has been described, a portion of the thermo-element 28 is located in the portion of the guide member 34 below the stepped portion 37, that is, the portion of the guide member 34 with a smaller inner diameter. Accordingly, the minimum cross-sectional area of the variable passage is small, compared to when the thermostat 18 is in the valve closed state.

As has been described, in the thermostat 18, the minimum cross-sectional area of the variable passage, which is formed in the clearance between the thermo-element 28 and the guide member 34, is smaller when the thermostat 18 is in the valve open state than when the thermostat 18 is in the valve closed state. Accordingly, when the temperature of the coolant water is high, the thermostat 18 functions to limit the circulation of the coolant water through the heater/bypass passage, that is, to increase the flow resistance to the coolant water circulating through the heater/bypass passage, compared to when the temperature of the coolant water is low. The portion of the guide member 34 below the stepped portion 37 functions as a restricting portion. The restricting portion decreases the minimum cross-sectional area of the variable passage when the valve body 32 permits the circulation of the coolant water through the main passage through the radiator 13, compared to when the valve body 32 stops the circulation of the coolant water through the main passage. However, the thermostat 18 is configured in such a manner that, even when the valve body 32 permits the circulation of the coolant water through the main passage, the minimum cross-sectional area of the variable passage becomes greater than or equal to the cross-sectional area that allows the heater/bypass passage to ensure the flow amount necessary for the passenger compartment heating performance (the heating performance required for the heater core 15).

The present embodiment, which has been explained above, has the advantages described below.

(1) The heater passage passing through the heater core 15 is the heater/bypass passage, which circulates the coolant water between the interior of the engine and the heater core 15 and functions also as a bypass passage that allows the circulating coolant water to bypass the radiator 13 when the engine is warming up. In other words, when the temperature of the coolant water is low, the coolant water is circulated through the heater/bypass passage by the amount corresponding to the total amount of the coolant water circulated through the main passage and the heater/bypass passage at the time when the temperature of the coolant water is high. This makes it unnecessary to form an independent bypass passage, thus simplifying the configuration of the passages.

(2) The thermostat 18 constantly permits the circulation of the coolant water through the heater/bypass passage, regardless of the temperature of the coolant water. Accordingly, the heat of the coolant water that has been heated by the engine and flows into the heater core 15 can constantly be used to heat the air, that is, to warm up the passenger compartment.

(3) When the temperature of the coolant water is high, the thermostat 18 limits the circulation of the coolant water through the heater/bypass passage, that is, increases the flow resistance to the coolant water circulating in the heater/bypass passage, compared to when the temperature of the coolant water is low. As a result, when the thermostat 18 is in the valve open state, the amount of the coolant water circulating through the heater/bypass passage decreases and the amount of the coolant water circulating through the main passage, which passes through the radiator 13, increases. This ensures a sufficient amount of coolant water circulating through the main passage and thus maintains a high cooling performance of the engine when the temperature of the coolant water is high.

(4) The thermostat 18 has the valve body 32 and the tubular guide member 34. The valve body 32 is moved in correspondence with the temperature of the coolant water flowing around the thermo-element 28 to selectively permit and stop the circulation of the coolant water through the main passage. The guide member 34 is arranged around the outer circumference of the thermo-element 28 and guides the coolant water that has flowed into the thermostat 18 via the heater/bypass passage to the space around the thermo-element 28. The thermostat 18 thus guides the coolant water circulating through the heater/bypass passage to the space around the thermo-element 28 by means of the guide member 34. This effectively exposes the thermo-element 28 to the coolant water, thus improving the responsiveness of the thermostat 18 to the temperature.

(5) When the valve body 32 of the thermostat 18 permits the circulation of the coolant water through the main passage, the minimum cross-sectional area of the variable passage, which is formed in the clearance between the thermo-element 28 and the guide member 34, is small compared to when the valve body 32 stops the circulation of the coolant water through the main passage. In other words, the thermostat 18 has the restricting portion that decreases the minimum cross-sectional area of the variable passage when the thermostat 18 is in the valve open state, compared to when the thermostat 18 is in the valve closed state. Accordingly, by a relatively simple configuration, the circulation of the coolant water through the heater/bypass passage is limited when the thermostat 18 is in the valve open state, compared to when the thermostat 18 is in the valve closed state.

The illustrated embodiment may be modified to the forms described below.

In the embodiment described above, the stepped portion 37 formed in the inner circumferential surface of the guide member 34 decreases the minimum cross-sectional area of the variable passage, which is formed between the guide member 34 and the thermo-element 28, when the thermostat 18 is in the valve closed state, compared to when the thermostat 18 is in the valve open state. However, the inner circumference of the guide member 34 may be configured in manners different from the manner employed in the embodiment, as long as the minimum cross-sectional area of the variable passage is decreased when the thermostat 18 is in the valve closed state compared to when the thermostat 18 is in the valve open state. For example, in a guide member 40 of the modification illustrated in FIG. 5, a plurality of projections 41, which extend in an up-and-down direction of the guide member 40, are formed in a lower portion of a guide member 40. The thermo-element 28 is arranged in the lower portion of the guide member 40 only when the thermostat 18 is in the valve closed state. Also in this case, the circulation of the coolant water through the heater/bypass passage is limited when the thermostat 18 is in the valve open state compared to when the thermostat 18 is in the valve closed state. In this structure, the portion from which the projections 41 are projected corresponds to the aforementioned restricting portion.

The minimum cross-sectional area of the variable passage may be decreased by a projection projected from the outer circumference of the thermo-element 28. For example, in the thermostat of the modification illustrated in FIG. 6, a guide member 42 has a uniform inner diameter from the upper end to the lower end of the guide member 42. A stepped portion 44 is formed in the outer circumferential surface of a thermo-element 43. The outer diameter of the portion of the thermo-element 43 above the stepped portion 44 is greater than the outer diameter of the portion of the thermo-element 43 below the stepped portion 44. The portion of the thermo-element 43 above the stepped portion 44 is located inside the guide member 42 only when the thermostat is in a valve open state. Also in this case, as in the case in which the stepped portion is formed at the inner circumference of the guide member, the minimum cross-sectional area of the variable passage is decreased when the thermostat is in the valve open state. In this configuration, the portion of the thermo-element 43 above the stepped portion 44 corresponds to the aforementioned restricting portion.

The above-described embodiment employs the thermostat having the guide member that is arranged around the outer circumference of the thermo-element and guides the coolant water that has been sent from the heater return passage 19 to the space around the thermo-element. However, the present invention may be carried out using a thermostat without the aforementioned guide member. Also in this case, in order to maintain the heater constantly in an operable state, it is desirable to configure the thermostat in such a manner that the circulation of the coolant water through the heater/bypass passage is constantly permitted. Further, in order to ensure a sufficient amount of coolant water circulating through the main passage after completion of engine warm-up and maintain effective cooling performance of the engine, it is desirable to employ a thermostat configured to limit the circulation of the coolant water through the heater/bypass passage when the temperature of the coolant water is high compared to when the temperature of the coolant water is low. However, even if the thermostat is configured to stop the circulation of the coolant water through the heater/bypass passage after completion of engine warm-up, the heater is maintained operable as long as the circulation of the coolant water through the heater/bypass passage can be resumed when necessary. Also, if the cooling performance of the engine is ensured without limiting the circulation of the coolant water through the heater/bypass passage particularly, a thermostat operating without limiting the circulation of the coolant water may be employed.

The configuration of the coolant water passages of the cooling device according to the above-described embodiment may be modified as needed. As long as a heater passage through which coolant water is circulated between the interior of the engine and the heater core functions also as a bypass passage that allows the coolant water to bypass the radiator while circulating, it is unnecessary to provide an additional bypass passage. This simplifies the configuration of the coolant water passages.

In the above-described embodiment, the present invention is used in the cooling device that maintains the temperature of the engine at an appropriate level by circulating the coolant water. However, the invention may also be employed in a cooling device using fluid other than the coolant water as circulating cooling medium.

The invention claimed is:

1. A cooling device for a vehicle, comprising:

a first passage through which a cooling medium is circulated between the an interior of an engine and a radiator;

a second passage through which the cooling medium is circulated between the interior of the engine and a heater core; and a thermostat that operates in response to a temperature of the cooling medium, wherein the thermostat permits circulation of the cooling medium in the first passage when the temperature of the cooling medium is high, and stops the circulation of the cooling medium in the first passage when the temperature of the cooling medium is low, wherein the second passage functions as a bypass passage through which the cooling medium circulates bypassing the radiator when the temperature of the cooling medium is low;

wherein the thermostat includes:

a temperature sensitive portion;

a valve body that is moved in correspondence with the temperature of the cooling medium flowing around the temperature sensitive portion, in such a manner as to selectively permit and stop the circulation of the cooling medium through the first passage; and a tubular guide member that covers an outer circumference of the temperature sensitive portion and guides the cooling medium that has flowed into the thermostat via the second passage to a space around the temperature sensitive portion;

wherein a clearance between the temperature sensitive portion and the guide member forms a variable passage; and wherein the thermostat is configured to decrease a minimum cross-sectional area of the variable passage when the valve body permits the circulation of the cooling medium through the first passage, compared to the minimum cross-sectional area of the variable passage at the time when the valve body stops the circulation of the cooling medium through the first passage.

2. A cooling device for a vehicle, comprising:

a first passage through which a cooling medium is circulated between an interior of an engine and a radiator;

a second passage through which the cooling medium is circulated between the interior of the engine and a heater core; and a thermostat that operates in response to a temperature of the cooling medium, wherein the thermostat permits circulation of the cooling medium in the first passage when the temperature of the cooling medium is high, and stops the circulation of the cooling medium in the first passage when the temperature of the cooling medium is low, wherein, when the temperature of the cooling medium is low, the cooling medium is circulated through the second passage by an amount corresponding to the total amount of the cooling medium circulated through the first and second passages at the time when the temperature of the cooling medium is high;

wherein the thermostat includes:

a temperature sensitive portion;

a valve body that is moved in correspondence with the temperature of the cooling medium flowing around the temperature sensitive portion, in such a manner as to selectively permit and stop the circulation of the cooling medium through the first passage; and a tubular guide member that covers an outer circumference of the temperature sensitive portion and guides the cooling medium that has flowed into the thermostat via the second passage to a space around the temperature sensitive portion;

wherein a clearance between the temperature sensitive portion and the guide member forms a variable passage; and wherein the thermostat has a restricting portion that decreases a minimum cross-sectional area of the variable passage when the valve body permits the circulation of the cooling medium through the first passage, compared to the minimum cross-sectional area of the variable passage at the time when the valve body stops the circulation of the cooling medium through the first passage.

* * * * *